US008751228B2

(12) United States Patent
Wang et al.

(10) Patent No.: US 8,751,228 B2
(45) Date of Patent: Jun. 10, 2014

(54) MINIMUM CONVERTED TRAJECTORY ERROR (MCTE) AUDIO-TO-VIDEO ENGINE

(75) Inventors: Lijuan Wang, Beijing (CN); Frank Kao-Ping Soong, Beijing (CN)

(73) Assignee: Microsoft Corporation, Redmond, WA (US)

( * ) Notice: Subject to any disclaimer, the term of this patent is extended or adjusted under 35 U.S.C. 154(b) by 839 days.

(21) Appl. No.: 12/939,528

(22) Filed: Nov. 4, 2010

(65) Prior Publication Data

US 2012/0116761 A1 May 10, 2012

(51) Int. Cl.
*G10L 21/06* (2013.01)

(52) U.S. Cl.
CPC ..... *G10L 21/06* (2013.01)
USPC ..... 704/235; 704/260; 704/276

(58) Field of Classification Search
CPC ..... G10L 21/06
USPC ..... 704/235, 256, 258, 270, 276
See application file for complete search history.

(56) References Cited

U.S. PATENT DOCUMENTS

| | | | | |
|---|---|---|---|---|
| 5,608,839 | A * | 3/1997 | Chen | 704/235 |
| 5,880,788 | A * | 3/1999 | Bregler | 348/515 |
| 5,983,190 | A * | 11/1999 | Trower et al. | 704/276 |
| 6,366,885 | B1 * | 4/2002 | Basu et al. | 704/270 |
| 6,735,566 | B1 * | 5/2004 | Brand | 704/256 |
| 6,813,607 | B1 | 11/2004 | Faruquie et al. | |
| 7,123,262 | B2 * | 10/2006 | Francini et al. | 345/473 |
| 7,433,490 | B2 | 10/2008 | Huang et al. | |
| 7,454,342 | B2 * | 11/2008 | Nefian et al. | 704/256 |
| 7,587,318 | B2 | 9/2009 | Seshadri | |
| 7,933,772 | B1 * | 4/2011 | Cosatto et al. | 345/473 |
| 2002/0116197 | A1 * | 8/2002 | Erten | 704/273 |
| 2002/0194006 | A1 * | 12/2002 | Challapali | 704/276 |
| 2005/0270293 | A1 * | 12/2005 | Guo et al. | 345/473 |
| 2006/0204060 | A1 * | 9/2006 | Huang et al. | 382/118 |

OTHER PUBLICATIONS

Huang et al. "Real-Time Lip-Synch Face Animation Driven by Human Voice", IEEE Workshop on Multimedia Signal Processing, 1998.*

Choi et al. "Hidden Markov Model Inversion for Audio-to-Visual Conversion in an MPEG-4 Facial Animation System", Journal of VLSI Signal Processing 29, 51-61, 2001.*

Tao et al. "Speech Driven Face Animation Based on Dynamic Concatenation Model", ournal of Information & Computational Science 3: 4, 2006.*

(Continued)

*Primary Examiner* — Jialong He

(74) *Attorney, Agent, or Firm* — Carole Boelitz; Micky Minhas; Lee & Hayes, PLLC

(57) ABSTRACT

Embodiments of an audio-to-video engine are disclosed. In operation, the audio-to-video engine generates facial movement (e.g., a virtual talking head) based on an input speech. The audio-to-video engine receives the input speech and recognizes the input speech as a source feature vector. The audio-to-video engine then determines a Maximum A Posterior (MAP) mixture sequence based on the source feature vector. The MAP mixture sequence may be a function of a refined Gaussian Mixture Model (GMM). The audio-to-video engine may then use the MAP to estimate video feature parameters. The video feature parameters are then interpreted as facial movement. The facial movement may be stored as data to a storage module and/or it may be displayed as video to a display device.

20 Claims, 5 Drawing Sheets

(56) References Cited

OTHER PUBLICATIONS

Chen, "Audiovisual Speech Processing", retrieved on Aug. 10, 2010 at <<http://ieeexplore.ieee.org/stamp/stamp.jsp?tp=&arnumber=911195>>, IEEE Signal Processing Magazine, Jan. 2001, pp. 9-21.

Chen, et al., "Speech-Assisted Lip Synchronization in Audio-Visual Communications", retrieved on Aug. 10, 2010 at <<http://ieeexplore.ieee.org/stamp/stamp.jsp?tp=&arnumber=537545>>, IEEE Computer Society, Proceedings of International Conference on Image Processing (ICIP), vol. 2, Oct. 1995, pp. 579-582.

Fu, et al., "Audio Visual Mapping With Cross-Modal Hidden Markov Models", retrieved on Aug. 10, 2010 at <<http://ieeexplore.ieee.org/stamp/stamp.jsp?tp=&arnumber=1407897>>, IEEE Transactions on Multimedia, vol. 7, No. 2, Apr. 2005, pp. 243-252.

Hong, et al., "Real-Time Speech-Driven Face Animation With Expressions Using Neural Networks", retrieved on Aug. 10, 2010 at <<http://ieeexplore.ieee.org/stamp/stamp.jsp?tp=&arnumber=1021892>>, IEEE Transaction on Neural Networks, vol. 13, No. 4, Jul. 2002, pp. 916-927.

Lavagetto, "Converting Speech into Lip Movements: A Multimedia Telephone for Hard of Hearing People", retrieved on Aug. 11, 2010 at <<http://ieeexplore.ieee.org/stamp/stamp.jsp?arnumber=00372898>>, IEEE Transactions on Rehabilitation Engineering, vol. 3, No. 1, Mar. 1995, pp. 90-102.

Nakamura, et al., "Speech-To-Lip Movement Synthesis Maximizing Audio-Visual Joint Probability Based on EM Algorithm", retrieved on Aug. 12, 2010 at <<http://ieeexplore.ieee.org/stamp/stamp.jsp?arnumber=00738912>>, IEEE Workshop on Multimedia Signal Processing, Redondo Beach, California, Dec. 1998, pp. 53-58.

Sako et al., "HMM-Based Text-to-Audio-Visual Speech Synthesis", Intl Conf on Speech and Language Processing, vol. 3, Oct. 2000, p. 25-28.

Toda, et al., "Voice Conversion Based on Maximum-Likelihood Estimation of Speech Parameter Trajectory", retrieved on Aug. 12, 2010 at <<http://ee602.wdfiles.com/local--files/report-presentations/Group_14>>, IEEE Transactions on Audio, Speech, and Language Processing, vol. 15, No. 8, Nov. 2007, pp. 2222-2235.

Wu, et al., "Minimum Generation Error Training for HMM-Based Speech Synthesis", retrieved on Aug. 10, 2010 at <<http://ieeexplore.ieee.org/stamp/stamp.jsp?arnumber=01659964>>, IEEE Proceedings of International Conference on Acoustics, Speech and Signal Processing (ICASSP), vol. 1, May 2006, pp. 89-92.

Xie et al., "A Coupled HMM Approach to Video-Realistic Speech Animation", Pattern Recognition, vol. 40, No. 8, Aug 2007, a special issue on Visual Information Processing, pp. 2325-2340.

Yamamoto, et al., "Lip Movement Synthesis from Speech Based on Hidden Markov Models", retrieved on Aug. 11, 2010 at <<http://ieeexplore.ieee.org/stamp/stamp.jsp?tp=&arnumber=670941>>, Elsevier Science Publishers, Speech Communication, vol. 26, No. 1-2, Oct. 1998, pp. 105-115.

* cited by examiner

MINIMUM CONVERTED TRAJECTORY ERROR (MCTE) AUDIO-TO-VIDEO ENGINE

BACKGROUND

An audio-to-video engine is a software program that generates a video of facial movements (e.g., a virtual talking head) from inputted speech audio. An audio-to-video engine may be useful in multimedia communication applications, such video conferencing, as it generating video in environments where direct video capturing is either not available or places an undesirable burden on the communication network. The audio-to-video engine may also be useful for increasing the intelligibility of speech.

In prior implementations, audio-to-video methods generally apply maximum likelihood estimation (MLE)-based conversion processes to a Gaussian Mixture Model (GMM) to estimate video feature vectors given a set of audio feature vectors. However, the MLE-based conversion processes typically include conversion errors since an audiovisual GMM with maximum likelihood on the training data does not necessarily result in converted visual trajectories that have minimized error in human perception.

SUMMARY

Described herein are techniques and systems for providing an audio-to-video engine that utilizes a Minimum Converted Trajectory Error (MCTE)-based process to refine a Gaussian Mixture Model (GMM). The refined GMM may then be used to convert input speech into realistic output video. Unlike previous methods which apply a maximum likelihood estimation (MLE)-based conversion process directly to the GMM to generate the video output, the MCTE-based process focuses on minimizing conversion errors of the MLE-based conversion process.

The MCTE-based process may refine the GMM in two steps. First, the MCTE-based process may weigh the audio data and the video data of the GMM separately using a log likelihood function. The MCTE-based process may then apply a generalized probabilistic descent (GPD) algorithm to refine the visual parameters of the GMM.

The audio-to-video engine may use the refined GMM to convert input speech into realistic output video. First, the audio-to-video engine may recognize the input speech as a source feature vector. The audio-to-video engine may then determine a Maximum A Posterior (MAP) mixture sequence based on the source feature vector and the refined GMM. Finally, the audio-to-video engine may estimate the video feature parameters using the MAP mixture sequence. The video feature parameters may be stored or may be output as a video of facial movements (e.g., a virtual talking head). Other embodiments will become more apparent from the following detailed description when taken in conjunction with the accompanying drawings.

This Summary is provided to introduce a selection of concepts in a simplified form that is further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The detailed description is described with reference to the accompanying Figures. In the Figures, the left-most digit(s) of a reference number identifies the Figure in which the reference number first appears. The use of the same reference number in different Figures indicates similar or identical items.

DETAILED DESCRIPTION

The embodiments described herein pertain to a Minimum Converted Trajectory Error (MCTE)-based audio-to-video engine that focuses on minimizing conversion errors of traditional MLE-based conversion processes. Accordingly, the audio-to-video engine may provide better user experience in comparison to other audio-to-video engines.

The processes and systems described herein may be implemented in a number of ways. Example implementations are provided below with reference to the following figures.

Illustrative Scheme

Figure 1:
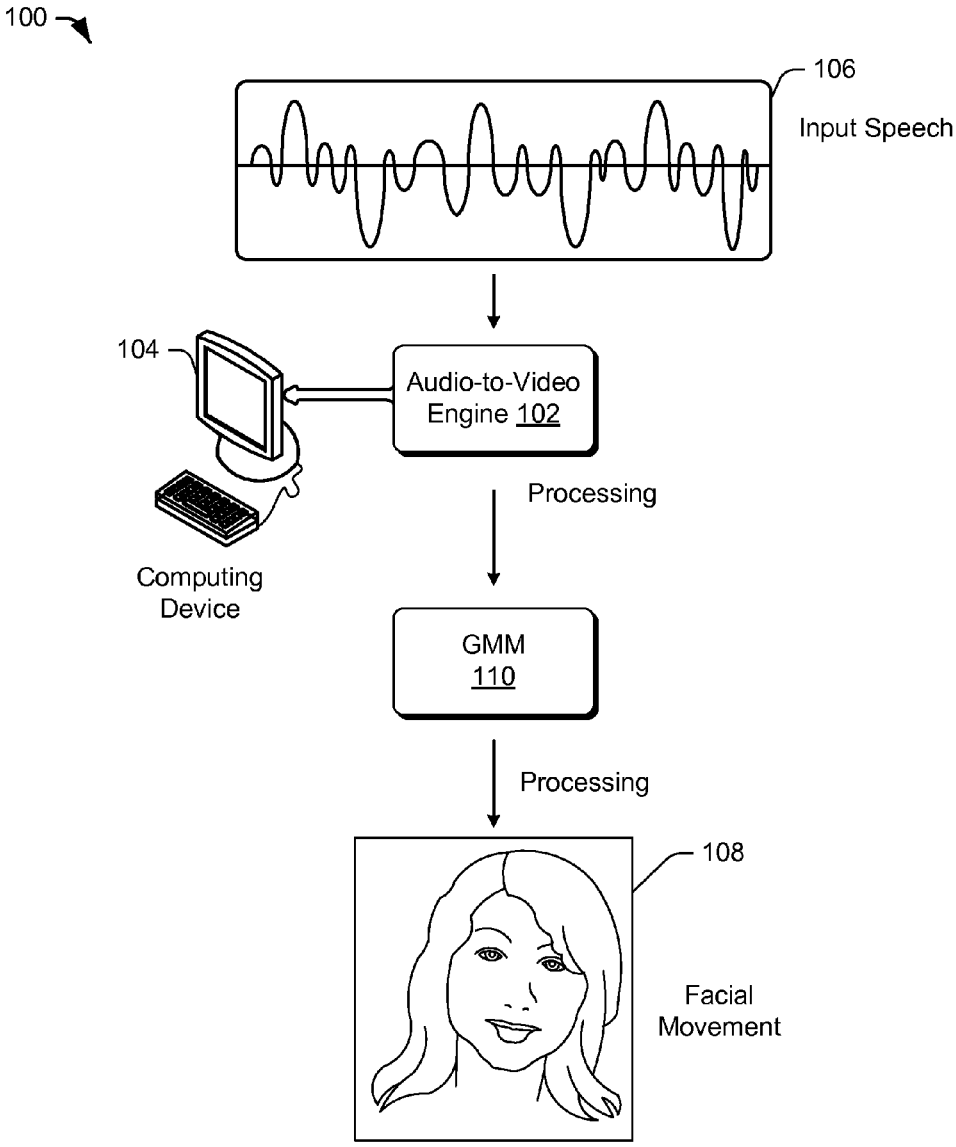
FIG. 1 is a block diagram that illustrates an illustrative scheme that implements the audio-to-video engine in accordance with various embodiments.

FIG. 1 is a block diagram of an illustrative scheme 100 that implements an audio-to-video engine 102 in accordance with various embodiments.

The audio-to-video engine 102 may be implemented on a computing device 104. The computing device 104 may be a computing device that includes one or more processors that provide processing capabilities and memory that provides data storage and retrieval capabilities. In various embodiments, the computing device 104 may be a general purpose computer, such as a desktop computer, a laptop computer, a server, or the like. However, in other embodiments, the computing device 104 may be a mobile phone, set-top box, game console, personal digital assistant (PDA), portable media player (e.g., portable video player) and digital audio player), net book, tablet PC, and other types of computing device. Further, the computing device 104 may have network capabilities. For example, the computing device 104 may exchange data with other computing devices (e.g., laptops computers, servers, etc.) via one or more networks, such as the Internet.

The audio-to-video engine 102 may convert an input speech 106 into facial movement 108. In various embodiments, the input speech 106 is inputted into the audio-to-video engine as digital data (e.g., audio data). The audio-to-video engine 102 may recognize the input speech 106 as a source feature vector where each time slice includes static and dynamic feature parameters which are each of one or more dimensions. In some instances, the dynamic feature parameters may be represented as a linear transformation of the static feature parameters. The input speech 106 may be of any linguistic content such as a Western speaking language (e.g., English, French, Spanish, etc.), an Asian language (e.g., Chinese, Japanese, and Korean etc), other known languages, numerical speech, input speech of which the linguistic content is unknown, or non-linguistic speech such as laughing, coughing, sneezing, etc.

During the conversion of input speech 106 into facial movement 108, the audio-to-video engine 102 may employ a Gaussian Mixture Model (GMM) 110. The GMM may be a joint GMM that contains a training set of video feature vectors, $\hat{y}$, 216 and corresponding audio feature vectors, X, 218. Unlike previous methods which convert input speech directly to output video using a maximum likelihood estimation (MLE)-based conversion process, the audio-to-video engine 102 may employ a Minimum Converted Trajectory Error (MCTE)-based process to refine the GMM. For example, the MCTE-based process may weigh an audio space of the GMM and a video space of the GMM separately using a log likelihood function. The MCTE-based process may then apply a generalized probabilistic descent (GPD) algorithm to replace the visual parameters of the GMM with updated visual parameters to generate the refined GMM.

The audio-to-video engine 102 may use the refined GMM to convert the input speech 106 into video feature parameters. The video feature parameters may be a feature vector $Y=[y_1, y_2, \ldots y_T]$ where each time slice may include static and dynamic feature parameters (i.e., $Y_T=[y_t; \Delta y_t]$) which are each of one or more dimensions, $D_y$. The dynamic feature parameters, $\Delta y_t$, of the target feature vector may be represented as a linear transformation of the static vectors $$\left(\text{i.e., } \Delta y_t = \frac{1}{2}(y_{t+1} - y_{t-1})\right).$$

The video feature parameters may be stored or may be processed into facial movements (e.g., a virtual talking head).

MLE-Based Conversion

Figure 2:
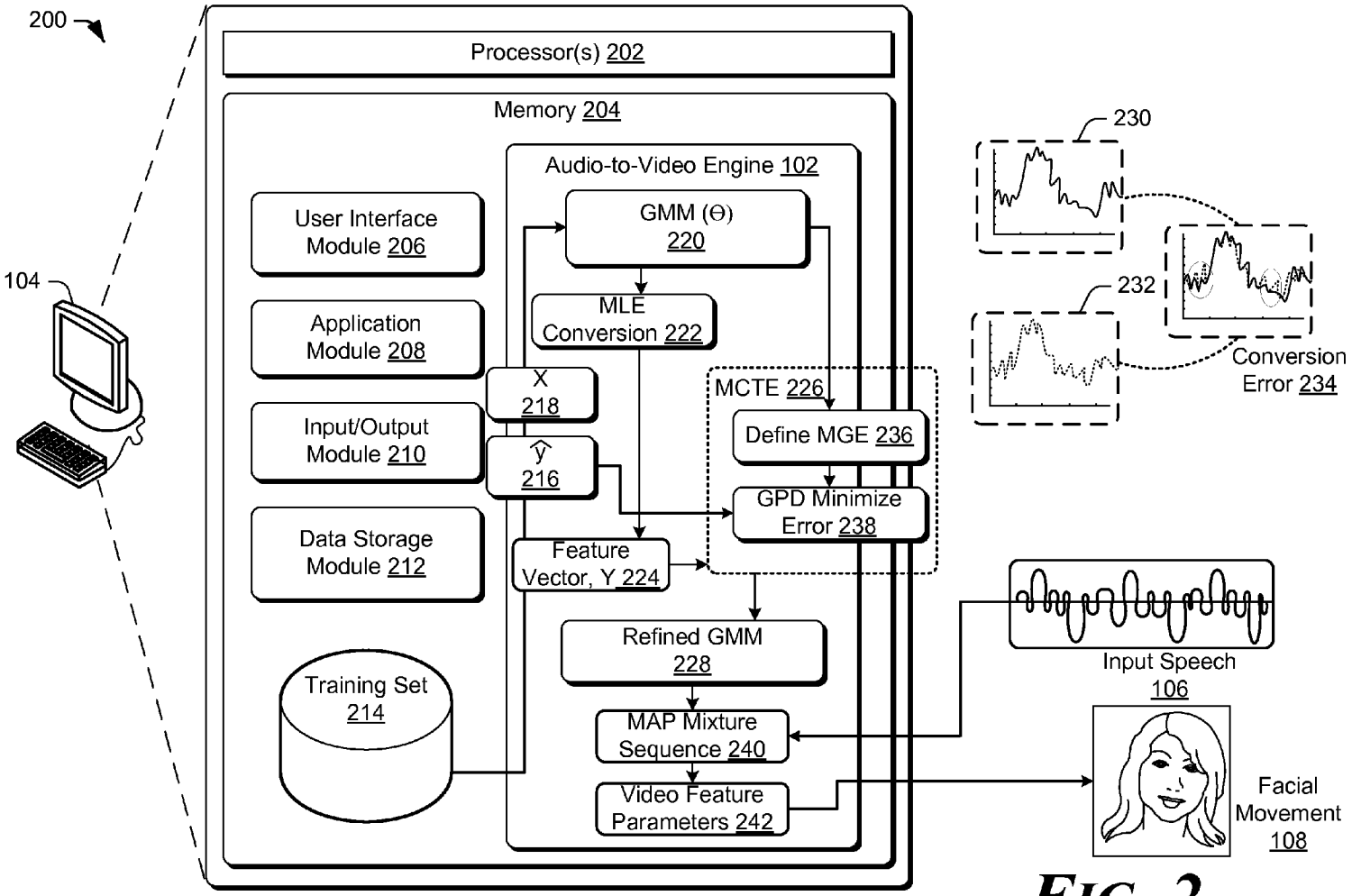
FIG. 2 is a block diagram that illustrates selected components of the audio-to-video engine in accordance with various embodiments.

FIG. 2 is an environment 200 that illustrates selected components of the audio-to-video engine 102 in accordance with various embodiments. The environment 200 is described with reference to the illustrative scheme 100 as shown in FIG. 1. The computing device 104 may include one or more processors 202 and memory 204.

The memory 204 may store components and/or modules. The components, or modules, may include routines, programs instructions, objects, and/or data structures that perform particular tasks or implement particular abstract data types. The selected components include the audio-to-video engine 102, a user interface module 206 to enable input and/or output communications, an application module 208 to utilize the audio-to-video engine 102, an input/output module 210 to facilitate the input and/or output communications, and a data storage module 212 to store data to the memory 204. The user interface module 206, application module 208, and input/output module 210 are described further below.

The data storage module 212 may store a training set 214 of video feature vectors, $\hat{y}$, 216 and corresponding audio feature vectors, X, 218 (i.e., speech data) to generate and refine a model for converting the input speech 106 into the facial movements 108.

The audio-to-video engine 102 may be operable to convert the input speech 106 into facial movement 108. In various embodiments, the audio-to-video engine 102 utilizes the video feature vectors, $\hat{y}$, 216 and corresponding audio feature vectors, X, 218 of the training set 214 to generate a Gaussian Mixture Model (GMM) 220. A GMM can be regarded as a type of unsupervised learning or clustering that estimates probabilistic densities using a mixture distribution.

The audio-to-video engine 102 may utilize a maximum likelihood estimation (MLE)-based conversion process 222 to convert the audio feature vectors, X, 218 to target feature vectors, Y, 224. The target feature vectors, Y, 224 may be a time sequence, $Y=[y_1, y_2, \ldots y_T]$, where each time slice includes static and dynamic feature parameters (i.e., $Y_T=[y_t; \Delta y_t]$) which are each of one or more dimensions, $D_y$. The dynamic feature parameters may be represented as a linear transformation of the static vectors $$\left(\text{e.g., } \Delta y_t = \frac{1}{2}(y_{t+1} - y_{t-1})\right).$$

A Minimum Converted Trajectory Error (MCTE) process 226 may refine the GMM 220 to generate a refined GMM 228. The audio-to-video engine 102 may then use the refined GMM 228 to convert the input speech 106 to the facial movement 108.

As noted above, the audio-to-video engine 102 may utilize the MLE-based conversion process 222 to convert the audio feature vectors, X, 218 to the target feature vectors, Y, 224. The MLE-based conversion process 222 used to convert the audio feature vectors, X, 218 to the target feature vectors Y 224 may be formulated as shown in equation (1) as follows:

$$\hat{y}=\text{argmax } P(Y|X) \approx \text{argmax } P(Y|X,\theta) \tag{1}$$

in which X is the audio feature vectors 218, and θ is the Gaussian Mixture Models (GMM) 220 derived using an expectation maximization (EM) for the probability $P(X_t, Y_t)$. In other words, $P(X_t, Y_t)$ is the probability density of the audio feature vectors, X, 218 and the target feature vectors, Y, 224. The audio feature vectors, X, 218 may be expressed as a time sequence vector $X=[x_1, x_2, \ldots x_T]$ where each time slice, $x_t$, may include static and dynamic feature parameters (i.e., $X_T=[x_t; \Delta X_t]$) which are each of one or more dimensions, D. In some instances, the dynamic feature parameters, $\Delta x_t$, may be represented as a linear transformation of the static feature parameters $$\left(\text{i.e., } \Delta x_t = \frac{1}{2}(x_{t+1} - x_{t-1})\right).$$

In some instances, the GMM, Θ, 220 may have multiple mixture components. Given that the GMM, Θ, 220 has M mixture components, the maximum likelihood estimation (MLE) of the target feature vector Y 224 based on the audio feature vectors, X, 218 may be determined as shown in equation (2) as follows:

$$\begin{aligned} P(X \mid Y) &= \sum_{M=1}^{M} P(m \mid X) P(Y \mid X, m) \\ &\approx \sum_{M=1}^{M} P(m \mid X, \theta) P(Y \mid X, m, \theta) \\ &\approx \prod_{t=1}^{T} \sum_{M=1}^{M} P(m_t \mid X_t, \theta) P(Y_t \mid X_t, m_t, \theta). \end{aligned} \tag{2}$$

The first product term of equation (2) may be written as shown in equation (3):

$$P(m_t \mid X_t, \theta) = \frac{\omega_{m_t} \aleph\left(X_t; \mu_{m_t}^{(X)}, \sum_{m_t}^{(XX)}\right)}{\sum_{n=1}^{M} \omega_n \aleph\left(X_t; \mu_n^{(X)}, \sum_{n}^{(XX)}\right)} \tag{3}$$

in which $\aleph(X; \mu, \Sigma)$ is generally a vector with Gaussian distribution where $\mu$ is the mean matrix and $\Sigma$ is the covariance matrix. In addition, $\omega$, is a continuous weight for individual clusters according to the source feature vector.

The second product term of equation (2) may be written as shown in equations (4), (5), and (6):

$$P(Y_t|X_t, m_t, \theta) = \aleph(Y_t; E_{m_t,t}^{(Y)}, D_{m_t}^{(Y)}) \tag{4}$$

In which $$E_{m_t,t}^{(Y)} = \mu_{m_t}^{(Y)} + \Sigma_{m_t}^{(YX)} \Sigma_{m_t}^{(XX)-1} (X_t - \mu_{m_t}^{(X)}) \tag{5}$$

$$D_{m_t}^{(Y)} = \mu_{m_t}^{(YY)} - \Sigma_{m_t}^{(YX)} \Sigma_{m_t}^{(XX)-1} \Sigma_{m_t}^{(XY)} \tag{6}$$

As noted above, the audio feature vectors, X, 218 and the target feature vectors, Y, 224 may include static and dynamic feature parameters (i.e., $X_T=[x_t; \Delta x_t]$ and $Y_T=[y_t; \Delta y_t]$, respectively). Accordingly, the target feature vectors, Y, 224 may be expressed as a linear transformation of the static feature parameters, Y=Wy, such that $$\Delta y_t = \frac{1}{2}(y_{t+1} - y_{t-1}).$$

Similarly, the audio feature vectors, X, 218 may be expressed as X=Wx, such that $$\Delta x_t = \frac{1}{2}(x_{t+1} - x_{t-1}).$$

Thus, equation (1) may be written as shown in equation (7):

$$\hat{y} \approx \operatorname{argmax} P(Wy|X, \theta) \tag{7}$$

In some instances, the complexity of solving equation (5) can be significantly reduced using two reasonable approximations. First, the summation over all mixture components, M, in equation (2) can be approximated with a single component sequence, $\hat{m}$, as shown in equation (8):

$$P(Y|X, \theta) \approx P(\hat{m}|X, \theta) P(Y|X, \hat{m}, \theta) \tag{8}$$

in which $\hat{m}$ is a Maximum A Posterior (MAP) single component sequence (i.e., $\hat{m}=\operatorname{argmax}_m P(m|X,\theta)$). Using this first approximation, equation (8) can be used to solve equation (7) in a closed form as shown in equations (9), (10), and (11):

$$\hat{y} = (W^T D_{\hat{m}}^{(Y)-1} W)^{-1} W^T D_{\hat{m}}^{(Y)-1} E_{\hat{m}}^{(Y)} \tag{9}$$

in which $$E_{\hat{m}}^{(Y)} = [E_{\hat{m}_1,1}^{(Y)}, \ldots; \ldots; \ldots, E_{\hat{m}_T,T}^{(Y)}] \tag{10}$$

$$D_{\hat{m}}^{(Y)-1} = \operatorname{diag}[D_{\hat{m}_1}^{(Y)-1}, \ldots; \ldots; \ldots, D_{\hat{m}_T}^{(Y)-1}] \tag{11}$$

The second approximation that may be applied to the MLE-based conversion process 222 is based on the observation that in a given mixture component, $m_o$, the full covariance matrix in the space of the audio feature vectors, X, and the target feature vectors, Y, can be portioned into $\Sigma_{m_o}^{(XX)}$, $\Sigma_{m_o}^{(YY)}$, $\Sigma_{m_o}^{(XY)}$, $\Sigma_{m_o}^{(YX)}$. Unlike voice conversion (i.e., a first audio signal is converted to a second audio signal), where there is a strong correlation between dimensions of the spaces of the audio feature vectors, X, and the target feature vectors, Y, (i.e., both X and Y are audio trajectories, and thus the $\Sigma_{m_o}^{(XY)}$ and $\Sigma_{m_o}^{(YX)}$ matrix is critical), there is no strong correlation between the spaces of X and Y in the audio-to-video conversion. Accordingly, the second estimation assumes that the $\Sigma_{m_o}^{(XY)}$ matrix is inconsequential. In other words, it is assumed that $\Sigma_{m_t}^{(YX)}=0$ in equations (5) and (6). Thus, equations (5) and (6) can be written as shown in equations (12) and (13):

$$E_{m_t,t}^{(Y)} \approx \mu_{m_t}^{(Y)} \tag{12}$$

$$D_{m_t}^{(Y)} \approx \Sigma_{m_t}^{(YY)} \tag{13}$$

Using the MLE-based conversion process 222 and the discussed assumptions, equation (1) may be written as shown in equation (14):

$$\hat{y} \approx \operatorname{argmax} \Pi_{t=1}^{T} P(\hat{m}|X_t, \theta) \aleph(Y_t; \mu_{m_t}^{(Y)}, \Sigma_{m_t}^{(YY)}). \tag{14}$$

Equation (14) can be solved as discussed above with respect to equation (9).

In summary, the MLE-based conversion process 222 utilizes equations (1)-(14) to generate the target feature vectors, Y, 224.

Audio-to-Video Conversion with MCTE

Although the above MLE-based conversion process 222 is effective, it does not necessarily optimize the audio-to-video conversion error. In other words, a comparison of the target feature vectors, Y, 224 (graphically depicted in FIG. 2 as the MLE-based converted video 230) to the feature vectors, $\hat{y}$, 216, (graphically represented in FIG. 2 as 232) illustrates conversion error 234 of the MLE-based conversion process. To compensate for the conversion error 234 of the MLE-based conversion process, the Minimum Converted Trajectory Error (MCTE) process 226 may refine the GMM 220 to generate the refined GMM 228.

The MCTE-based process may refine the GMM 220 using two steps. First, the MCTE-based process may refine the GMM 220 using a minimum generation error (MGE) 236 which analyzes the spaces of the audio feature vectors, X, 218 and the target feature vectors, Y, 224 separately. Second, the MCTE-based process may apply a generalized probabilistic descent (GPD) algorithm to further refine the GMM.

In general, the MLE-based conversion process imposes equal weights on all the feature dimensions (i.e., $D_x=D_y$). Although such restriction may be satisfactory for audio-to-audio conversions where the input audio signal and the output audio signal have similar dimensions, this is not necessarily satisfactory for audio-to-video conversions where the dimensions of the video feature vectors, $\hat{y}$, and the audio feature vectors, X, 218 are not necessarily of the same order. Accordingly, the MCTE-based process may first refine the GMM 220 using the MGE 236 which analyzes the spaces of the audio feature vectors, X, 218 and the target feature vectors, Y, 224 separately.

In some instances, the MGE 236 weighs the audio space of the audio feature vectors, X, 218 and the video space of the target feature vectors, Y, 224 separately with parameters $\alpha_x$ and $\alpha_y$, respectively. Specifically, a log likelihood function approximated with a single mixture component is used to define the minimum generation error (MGE) 236 as shown in equation (15) as follows:

$$\log\left(\aleph\left([XY];\mu_m,\sum_m\right)\right)=-\log\left((2\pi)^D\left|\sum_m^{(XX)\alpha_X}\sum_m^{(YY)\alpha_Y}\right|^{\frac{1}{2}}\right)-\frac{1}{2}\propto_X (X-\mu_m^X)^T\sum_m^{(XX)-1}(X-\mu_m^X)-\frac{1}{2}\propto_Y (Y-\mu_m^Y)^T\sum_m^{(XX)-1}(Y-\mu_m^Y) \tag{15}$$

Weighing the audio space of the audio feature vectors, X, 218 and the video space of the target feature vectors, Y, 224 separately reduces the mean square error of the MLE-based conversion process 222 results. In some instances, heavier weighting on the audio space of the audio feature vectors, X, 218 in equation (15) leads to more distinguishable mixture components in the P(m|X, θ) component of equation (2) but increased perplexity of P(Y|X, m, θ) component. In such instances, the P(m|X, θ) component may dominate the approximation quality of equation (2). In some non-limiting instances, the weighting parameters may be selected to be $\alpha_x=1$ and $\alpha_y=1$.

Second, the MCTE-based process may apply a generalized probabilistic descent (GPD) algorithm to further refine the GMM. A GPD algorithm 238 may further refine the GMM by minimizing the conversion error 234 of the MLE-based conversion process. In general, the conversion error 234 may be defined as the Euclidean distance, D, between the target feature vectors, Y, 224 (graphically depicted in FIG. 2 as the MLE-based converted video 230) and the feature vectors, ŷ, 216, (graphically represented in FIG. 2 as 232) as shown in equation (16):

$$D(y,\hat{y})=\Sigma_{t=1}^{T}\|y_t-\hat{y}_t\| \tag{16}$$

With the approximation using the MAP mixture component sequence adopted in equation (8), the conversion problem, i.e., maximizing P(Y|X, θ), may include the following two steps. First, given the sequence of audio feature vectors, X, 218, a MAP mixture sequence is estimated, $\hat{m}=\text{argmax}_m P(m|X,\theta)$). Second, given the MAP mixture sequence, the corresponding target feature vectors, Y, 224 are estimated by maximizing P(Y|X, m̂, θ). Note that the second step is the same as a parameter generation problem for a single component sequence m̂. In other words, the conversion problem is solved by generating features from a corresponding hidden Markov model (HMM), which has a sequence of states and Gaussian kernels m̂ determined by the MAP process. The following cost function, L(θ), shown in equation (17) may be used to minimize the conversion error 234 between the target feature vectors, Y, 224 (graphically depicted in FIG. 2 as the MLE-based converted video 230) and the feature vectors, ŷ, 216, (graphically represented in FIG. 2 as 232):

$$L(\theta)=\frac{1}{N}\sum_{i=1}^{N}D(y^i,\hat{y}^i(\hat{m}^i,\theta)) \tag{17}$$

in which N is the number of training utterances.

Using the GPD algorithm 238, given the nth training utterance, the updating rule for the parameters of the mixtures on the MAP sequence is shown in equation (18) as follows:

$$\theta(n+1)=\theta(n)-\epsilon_n\frac{\partial}{\partial\theta}D(y^n,\hat{y}^n(\hat{m}^n,\theta)) \tag{18}$$

-continued $$\left|_{\theta=\theta(n)}\frac{\partial}{\partial\theta}D(y^n,\hat{y}^n(\hat{m}^n,\theta))\right.$$

$$=2(y^n(\hat{m}^n,\theta)-y^n)^T\frac{\partial}{\partial\theta}\hat{y}^n(\hat{m}^n,\theta)$$

Applying equation (9) to equation (18) yields equation (19) as follows:

$$\frac{\partial\hat{y}^n(\hat{m}^n,\theta)}{\partial E^{(Y)}_{\hat{m}_t,t,d}}=\left(W^T\left(D^{(y)}_{\hat{m}}\right)^{-1}W\right)^{-1}W^T\left(D^{(Y)}_{\hat{m}}\right)^{-1}Z_E \tag{19}$$

in which $E_{\hat{m}_t,t,d}^{(Y)}$ is the $d^{th}$ dimension of the mean vector of the $t^{th}$ mixture in E(Y) is the MAP mixture sequence, and $Z_E=[o,\ldots 0, 1_{t\times Dy+d}, 0,0,\ldots,0]^T$.

In some instances, $\Sigma_{m_o}^{(YY)}$ is assumed to have only diagonal non-zero elements (i.e., $\sigma_{t,d}^2$ is the variance corresponding to $E_{\hat{m}_t,t,d}^{(Y)}$). If $\nu_{t,d}=1/\sigma t,d^2$ and $Z_v=Z_E Z_Z^T$, then equation (19) can be represented as shown in equation (20):

$$\frac{\partial\hat{y}^n(\hat{m}^n,\theta)}{\partial E^{(Y)}_{\hat{m}_t,t,d}}=\left(W^T\left(D^{(y)}_{\hat{m}}\right)^{-1}W^T Z_v(E^{(Y)}_{\hat{m}}-W\hat{y}^n(\hat{m}^n,\theta))\right) \tag{20}$$

In contrast to the MGE, which directly estimates the parameters in the involved HMMs, the Minimum Converted Trajectory Error (MCTE)-based process 226 uses the generalized probabilistic descent (GPD) algorithm 238 to update the target feature vectors of the MAP mixture component sequence. In other words, the MCTE-based process replaces the video parameters of the GMM with updated video parameters to generate the refined GMM 228.

Audio-to-Video Mapping

After the Minimum Converted Trajectory Error (MCTE)-based process refines the GMM 220, the refined GMM 228 may be used to convert the input speech 106 to the corresponding facial movement 108. First, the audio-to-video engine 102 may recognize the input speech 106 as a source feature vector $X=[x_1, x_2, x_T]$ where each time slice, $x_t$, is a temporal frame of audio feature vector. As discussed above in FIG. 1, each frame, $x_t$, of the source feature vector may include static and dynamic feature parameters (i.e., $X_T=[x_t;\Delta X_t]$) which are each of one or more dimensions, D. The dynamic feature parameters, $\Delta x_t$, may be represented as a linear transformation of the static feature parameters $$\left(\text{i.e., } \Delta x_t=\frac{1}{2}(x_{t+1}-x_{t-1})\right).$$

Next, the audio-to-video engine 102 may determine a MAP mixture sequence 240 of the input speech, $\hat{m}=\text{argmax}_m P(m|X,\theta)$). In some instances, the audio-to-video engine 102 utilizes techniques similar to the GPD algorithm 238 to determine the MAP mixture sequence 240. Next, the audio-to-video engine 102 may estimate video feature parameters, Y, 242 using the MAP mixture sequence 240 by maximizing P(Y|X, m̂, θ). Finally, the video feature parameters 242 may be stored or may be output as a video of facial movements (e.g., a virtual talking head).

In various embodiments, referring to FIG. 2, the audio-to-video engine converts the input speech 106 into corresponding facial movement 108. The user interface module 206 may interact with a user via a user interface to enable input and/or output communications. The user interface may include a data output device (e.g., visual display, audio speakers), and one or more data input devices. The data input devices may include, but are not limited to, combinations of one or more of keypads, keyboards, mouse devices, touch screens, microphones, speech recognition packages, and any other suitable devices or other electronic/software selection processes. In some instances, the user interface module 206 may enable a user to input or select the input speech 106 for conversion into facial movement 108. Moreover, the user interface module 206 may provide the facial movement 108 to a visual display for video output.

The application module 208 may include one or more applications that utilize the audio-to-video engine 102. For example, but not as a limitation, the one or more application may include a mobile device application of a talking head that reads any text such as news stories or electronic mail (e-mail). In some instances, the one or more application may include a multimedia communication applications such as video conferencing that use voice to drive a talking head. In other instances, the one or more application may include speech conversion applications which outputs the converted speech via a talking head. In further instances, the one or more application may include remote educational applications that convert text-based education material to a talking head instructor. The one or more application may even include applications utilized to increase the intelligibility of speech, and the like. Accordingly, in various embodiments, the audio-to-video engine 102 may include one or more interfaces, such as one or more application program interfaces (APIs), which enable the application module 208 to provide input speech 106 to the audio-to-video engine 102.

The input/output module 210 may enable the audio-to-video engine 102 to receive input speech 106 from another device. For example, the audio-to-video engine 102 may receive input speech 106 from at least one of another electronic device, (e.g., a server) via one or more networks.

As described above, the data storage module 212 may store the training set 214 of video feature vectors, $\hat{y}$, 216 and corresponding audio feature vectors, X, 218 (i.e., speech data). The data storage module 212 may further store one or more input speeches 106, as well as one or more video feature parameters 242 and/or facial movements 108. The data storage module 212 may also store any additional data used by the audio-to-video engine 102, such as, but not limited to, the weighting parameters $\alpha_x$ and $\alpha_y$.

Illustrative Processes

Figure 3:
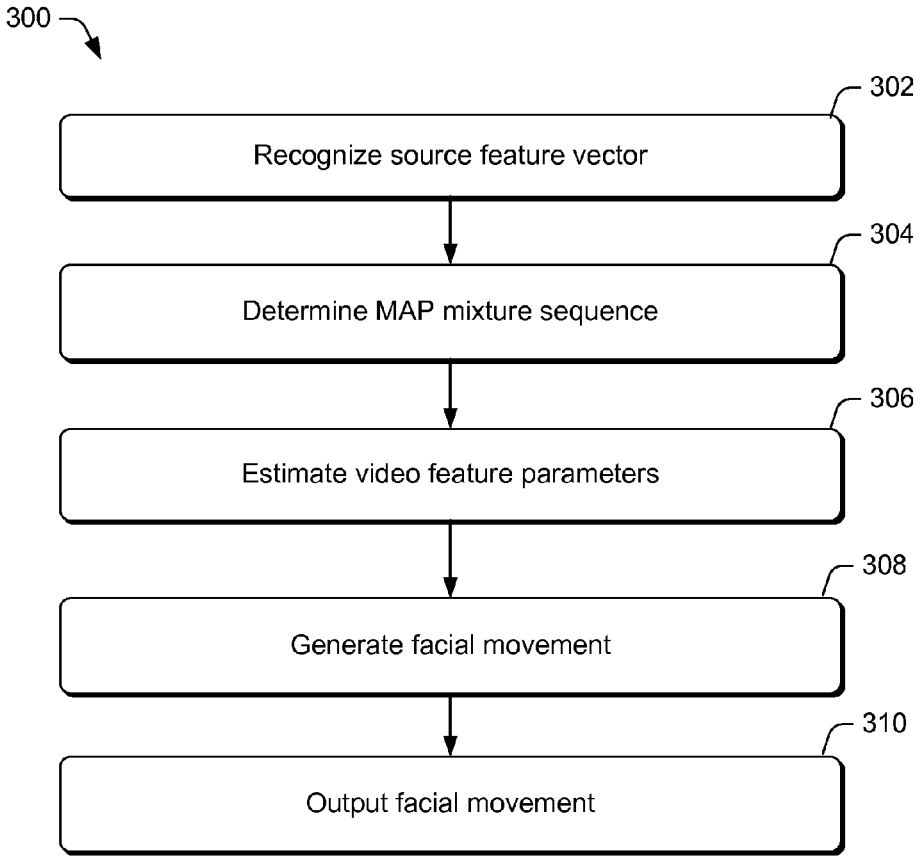
FIG. 3 is a flow diagram that illustrates an illustrative process to generate video feature parameters from input speech via the audio-to-video engine in accordance with various embodiments.
Figure 4:
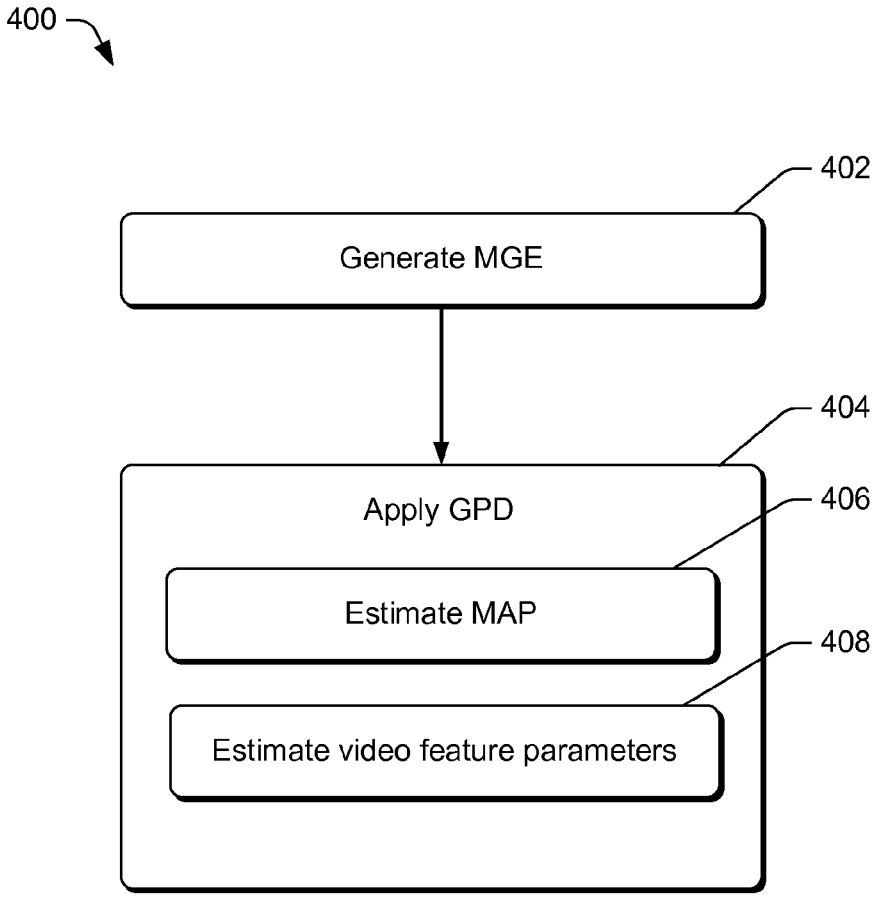
FIG. 4 is a flow diagram that illustrates an illustrative process to refine a Gaussian Mixture Model (GMM) in accordance with various embodiments.

FIGS. 3-4 describe various illustrative processes for implementing the audio-to-video engine 102. The order in which the operations are described in each illustrative process is not intended to be construed as a limitation, and any number of the described blocks can be combined in any order and/or in parallel to implement each process. Moreover, the blocks in the FIGS. 3-4 may be operations that can be implemented in hardware, software, and a combination thereof. In the context of software, the blocks represent computer-executable instructions that, when executed by one or more processors, cause one or more processors to perform the recited operations. Generally, computer-executable instructions include routines, programs, objects, components, data structures, and the like that cause the particular functions to be performed or particular abstract data types to be implemented.

FIG. 3 is a flow diagram that illustrates an illustrative process 300 to generate facial movement from input speech via the audio-to-video engine 102 in accordance with various embodiments.

At block 302, the audio-to-video engine 102 may receive an input speech 106 and recognize the input speech as one or more source feature vectors $X=[x_1, x_2, \ldots x_T]$. The source feature vectors may include static and dynamic feature parameters which are each of one or more dimensions. The audio-to-video engine 102 may generate the static feature parameters from a phoneme structure of the input speech.

At block 304, the audio-to-video engine 102 may determine a Maximum A Posterior (MAP) mixture sequence 240 based on the source feature vectors. In some instances, the MAP mixture sequence 240 is a function of the refined Gaussian Mixture Model (GMM) 228 which includes both audio parameters and updated video parameters. The updated video parameters of the refined GMM 228 may be updated based on the Minimum Converted Trajectory Error (MCTE) process 226 described above in FIG. 2. For instance, the MCTE process 226 may refine the GMM 220 by minimizing the conversion error 234 of the MLE-based conversion process.

In some instances, the audio-to-video engine 102 refines the GMM 220 by weighing the video space of the video feature vectors and the audio space of the of the audio feature vectors separately as illustrated in equation (15). The audio-to-video engine 102 may further refine the GMM 220 using the generalized probabilistic descent (GPD) algorithm 238 as illustrated in equations (16)-(20).

At block 306, the audio-to-video engine 102 may estimate the video feature parameters 242 using the MAP mixture sequence 240.

At block 308, the audio-to-video engine 102 may generate the facial movement 108 based on the estimated video feature parameters 242.

At block 310, the audio-to-video engine 102 may output (e.g., render) the facial movement 108. In various embodiments, the computing device 104 on which the audio-to-video engine 102 resides may include a display device to display the facial movement 108 as video to a user. The computing device 104 may also store the facial movement 108 as data in the data storage module 212 for subsequent retrieval and/or output.

FIG. 4 is a flow diagram that illustrates an illustrative process 400 to refine the GMM 220 to generate the refined GMM 228 using the audio-to-video engine in accordance with various embodiments. The illustrative process 400 may further illustrate operations performed during the determining the MAP mixture sequence 240 in block 304 of the illustrative process 300.

At block 402, the audio-to-video engine 102 may generate a minimum generation error (MGE) 236 based on the GMM 220. The audio-to-video engine 102 may apply a log likelihood function approximated with a single mixture component as illustrated in Equation 15 to generate the MGE 236. In some instances, the a log likelihood function weighs the audio space of the audio feature vectors, X, 218 and the video space of the target feature vectors, Y, 224 separately with parameters $\alpha_x$ and $\alpha_y$ respectively.

At block 404, the audio-to-video engine 102 may apply the generalized probabilistic descent (GPD) algorithm 238 as illustrated in equations (16)-(20) to refine the GMM 220. Applying the GPD algorithm at 404 may include estimating the Maximum A Posterior (MAP) mixture sequence at 406 and estimating the video feature parameters 242 at 408. In contrast to previous processes, which directly estimate the parameters in the involved HMMs, the MCTE process of process 400 uses the GPD algorithm 238 to update the video parameters of the GMM 220. In turn, the updated video parameters replace the corresponding video parameters in the GMM 220 to generate the refined GMM 228.

Illustrative Computing Device

Figure 5:
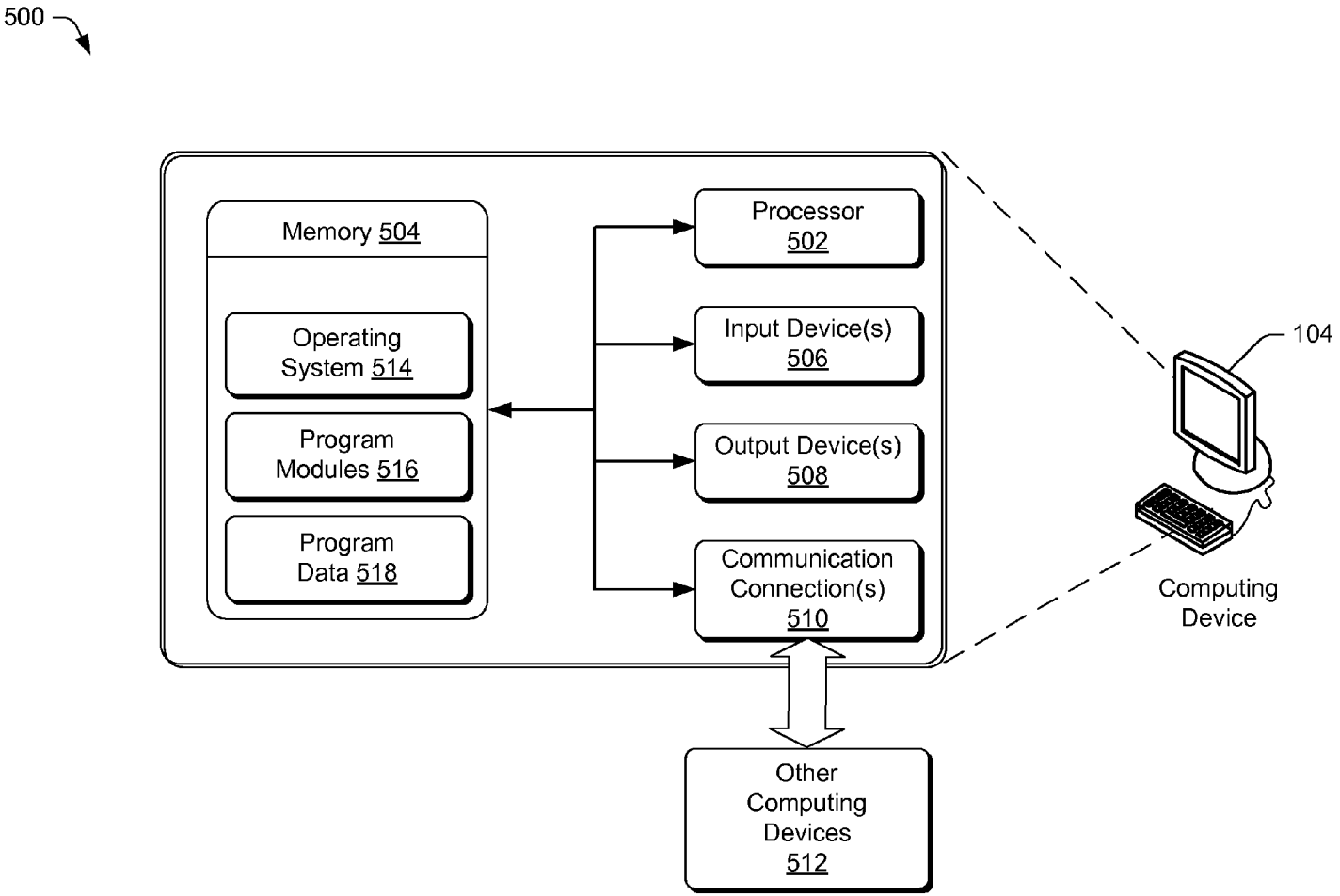
FIG. 5 is a block diagram that illustrates a representative system that may implement the audio-to-video engine.

FIG. 5 illustrates a representative system 500 that may be used to implement the audio-to-video engine, such as the audio-to-video engine 102. However, it will readily appreciate that the techniques and mechanisms may be implemented in other systems, computing devices, and environments. The system 500 may include the computing device 104 of FIG. 1. However, the computing device 104 shown in FIG. 5 is only one illustrative of a computing device and is not intended to suggest any limitation as to the scope of use or functionality of the computer and network architectures. Neither should the computing device 104 be interpreted as having any dependency nor requirement relating to any one or combination of components illustrated in the illustrative system 500.

The computing device 104 may be operable to generate facial movement from input speech. For instance, the computing device 104 may be operable to input the input speech 106, recognize the input speech as one or more source feature vectors, determine a Maximum A Posterior (MAP) mixture sequence-based on the source feature vectors, estimate the video feature parameters 242 using the MAP mixture sequence, and generate the facial movement-based on the estimated video feature parameters.

In at least one configuration, the computing device 104 comprises one or more processors 502 and memory 504. The computing device 104 may also include one or more input devices 506 and one or more output devices 508. The input devices 506 may be a keyboard, mouse, pen, voice input device, touch input device, etc., and the output devices 508 may be a display, speakers, printer, etc. coupled communicatively to the processor 502 and the memory 504. The computing device 104 may also contain communications connection(s) 510 that allow the computing device 104 to communicate with other computing devices 512 such as via a network.

The memory 504 of the computing device 104 may store an operating system 514, one or more program modules 516, and may include program data 518. The memory 504, or portions thereof, may be implemented using any form of computer-readable media that is accessible by the computing device 104. Computer-readable media includes, at least, two types of computer-readable media, namely computer storage media and communications media Computer storage media includes volatile and non-volatile, removable and non-removable media implemented in any method or technology for storage of information such as computer readable instructions, data structures, program modules, or other data. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device.

In some instances, the program modules 516 may be configured to generate facial movement from input speech using the process 300 illustrated in FIG. 3. For instance, the computing device 104 may be operable to input the input speech 106, recognize the input speech as one or more source feature vectors, determine a Maximum A Posterior (MAP) mixture sequence-based on the source feature vectors, estimate the video feature parameters using the MAP mixture sequence, generate facial movement-based on the estimated video feature parameters, and store the facial movement to the program data 518.

Conclusion

In closing, although the various embodiments have been described in language specific to structural features and/or methodological acts, it is to be understood that the subject matter defined in the appended representations is not necessarily limited to the specific features or acts described. Rather, the specific features and acts are disclosed as exemplary forms of implementing the claimed subject matter.

The invention claimed is:

1. A computer readable storage medium storing computer-executable instructions that, when executed, cause one or more processors to perform acts comprising:

generating source feature vectors for an input speech;

deriving a Maximum A Posterior (MAP) mixture sequence based at least partially on the source feature vectors using a Gaussian Mixture Model (GMM), the GMM being refined by a minimum generation error (MGE) process;

refining visual parameters of the GMM by weighing an audio space of the GMM and a video space of the GMM with separate weight parameters;

estimating video feature parameters using the MAP mixture sequence; and generating facial movement based on the video feature parameters.

2. The computer readable storage medium of claim 1, further storing an instruction that, when executed, cause the one or more processors to perform an act comprising outputting the facial movement to at least one of a visual display or a data storage.

3. The computer readable storage medium of claim 1, wherein the source feature vectors include static feature parameters and dynamic feature parameters.

4. The computer readable storage medium of claim 1, wherein the video feature parameters include static feature parameters and dynamic feature parameters.

5. The computer readable storage medium of claim 1, wherein the deriving further is based at least partially on applying a generalized probabilistic descent (GPD) algorithm to refine visual parameters of the GMM by minimizing a conversion error of a maximum likelihood estimation (MLE)-based conversion process.

6. The computer readable storage medium of claim 1, wherein the deriving further includes refining visual parameters of the GMM including:

applying a log likelihood function approximated with a single mixture component to define a MGE; and applying a generalized probabilistic descent (GPD) algorithm to minimize a conversion error of a maximum likelihood estimation (MLE)-based conversion process.

7. A computer implemented method, comprising:

under control of one or more computing systems configured with executable instructions, deriving video feature parameters for an input speech using a refined Gaussian Mixture Model (GMM), the refining comprising:

using a minimum generation error (MGE) process to weigh an audio space of the GMM and a video space of the GMM with separate weight parameters; and applying a generalized probabilistic descent (GPD) algorithm to minimize a conversion error of a maximum likelihood estimation (MLE)-based conversion process; and generating facial movement that represents visual characteristics of the input speech based on the refined GMM.

8. The computer implemented method of claim 7, further comprising utilizing the MLE-based conversion process to calculate target feature vectors, and wherein the GPD minimizes a conversion error of the target feature vectors.

9. The computer implemented method of claim 7, wherein the minimum generation error (MGE) process uses a log likelihood function that weighs the audio space of the GMM and the video space of the GMM with the separate weight parameters.

10. The computer implemented method of claim 7, wherein the deriving further includes estimating a Maximum A Posterior (MAP) mixture sequence using a GMM, estimating updated video feature vectors using the MAP mixture sequence, and replacing visual parameters of the GMM with the updated video feature vectors.

11. The computer implemented method of claim 7, wherein the GPD algorithm minimizes the conversion error of the MLE-based conversion method by updating visual parameters of a GMM with updated video feature vectors.

12. The computer implemented method of claim 7, wherein the deriving includes recognizing the input speech as a source feature vector, estimating a Maximum A Posterior (MAP) mixture sequence based on the refined GMM and the source feature vector, estimating the video feature parameters using the MAP mixture sequence, and generating the facial movement-based on the video feature parameters.

13. The computer implemented method of claim 7, wherein the video feature parameters include static feature parameters and dynamic feature parameters.

14. The computer implemented method of claim 7, wherein the video feature parameters include static feature parameters and dynamic feature parameters, the dynamic feature parameters being represented as a linear transformation of the static feature parameters.

15. A computer-implemented system for synthesizing input speech that includes computer components stored in a computer readable media and executable by one or more processors, the computer components comprising:

an audio-to-video engine to generate video feature parameters for an input speech using a Gaussian Mixture Model (GMM), wherein the GMM is refined by using a minimum generation error (MGE) process and the GMM includes audio parameters and updated video parameters, the audio parameters and the updated video parameters being weighted separately; and a data storage module to store facial movement associated with the video feature parameters.

16. The system of claim 15, wherein the audio-to-video engine trains the GMM using a generalized probabilistic descent (GPD) algorithm to minimize a conversion error of a maximum likelihood estimation (MLE)-based conversion process.

17. The system of claim 15, wherein the video feature parameters include static feature parameters and dynamic feature parameters.

18. The system of claim 15, wherein the audio-to-video engine generates the video feature parameters by recognizing the input speech as a source feature vector, estimating a Maximum A Posterior (MAP) mixture sequence based on the GMM and the source feature vector, estimating the video feature parameters using the MAP mixture sequence, and generating the facial movement-based on the video feature parameters.

19. The system of claim 17, wherein the dynamic feature parameters are represented as a linear transformation of the static feature parameters.

20. The computer readable storage medium of claim 1, wherein the input speech comprises at least one of:

linguistic content wherein the content is known;

numeral speech;

linguistic content wherein the content is unknown; or non-linguistic speech.

* * * * *